US005726533A

United States Patent [19]

Grote et al.

[11] Patent Number: 5,726,533

[45] Date of Patent: Mar. 10, 1998

[54] CATHODE RAY TUBE HAVING AN INPUT RESONATOR CAVITY

[75] Inventors: Stefan Grote, Wedel; Horst Seifert, Schneverdingen-Insel, both of Germany

[73] Assignee: U.S. Philips Corporation, New York, N.Y.

[21] Appl. No.: 764,164

[22] Filed: Dec. 13, 1996

Related U.S. Application Data

[63] Continuation of Ser. No. 346,944, Nov. 29, 1994, abandoned.

[30] Foreign Application Priority Data

Nov. 29, 1993 [DE] Germany ..... 43 40 550.9

[51] Int. Cl.[6] ..... H01J 23/18

[52] U.S. Cl. ..... 315/5; 330/45; 313/364

[58] Field of Search ..... 313/364, 409, 313/441, 477 R; 315/5, 4, 5.33, 5.29, 5.39; 330/44, 45

[56] References Cited

U.S. PATENT DOCUMENTS 2,442,662 6/1948 Peterson ..... 330/45

3,646,382 2/1972 Goede et al. ..... 313/495

FOREIGN PATENT DOCUMENTS 4107552 9/1991 Germany .

*Primary Examiner*—Nimeshkumar Patel

*Attorney, Agent, or Firm*—John C. Fox

[57] ABSTRACT

The invention relates to a cathode ray tube having an input resonator cavity which includes a first metal wall (2) and, spaced apart therefrom, a second metal wall (3) each conveying a low electric potential and constituting coupling areas (6, 7) at axially spaced locations, in which areas metal elements (10, 12) conveying a high electric potential are located opposite surface sections (8, 9 and 14, 15) which are electrically connected to the metal walls (2, 3) via insulating dielectrics (11, 13), the coupling areas (6, 7) being separated by a spacing dielectric. A high-voltage stable arrangement which is resistant to temperature fluctuations is obtained in that the spacing dielectric consists of a different material than the insulating dielectrics (6, 7) and has a lower value of the product of loss factor and dielectric constant ($tg\delta \times \epsilon$) at a high frequency.

8 Claims, 1 Drawing Sheet

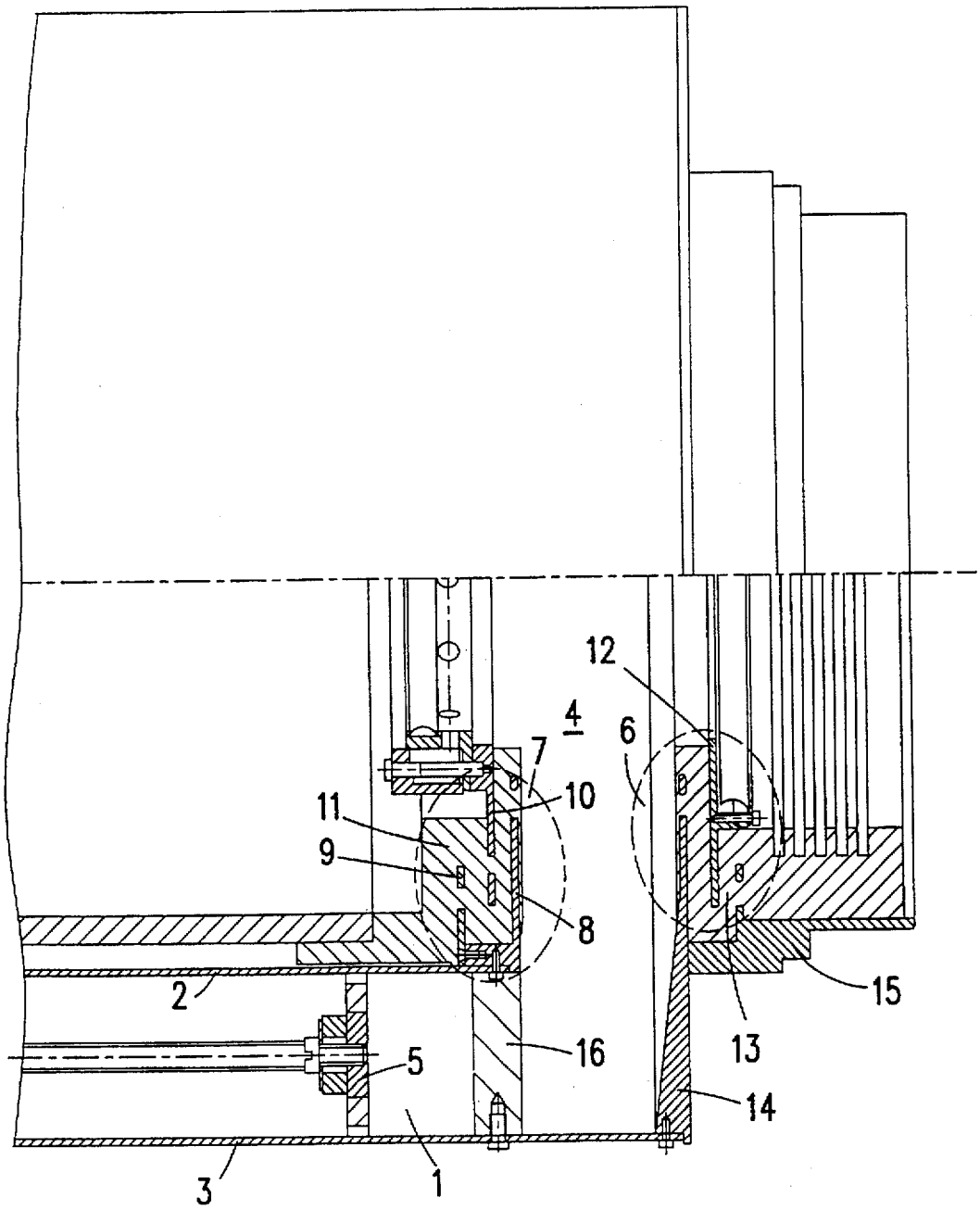
12
4
6
7
10
11
9
8
2
15
13
16
5
14
3
1

CATHODE RAY TUBE HAVING AN INPUT RESONATOR CAVITY

This is a continuation of application Ser. No. 08/346,944, filed Nov. 29, 1994, now abandoned.

FIELD OF INVENTION

The invention relates to a cathode ray tube having an input resonator cavity which comprises a first metal wall and, spaced apart therefrom, a second metal wall each conveying a low electric potential and constituting coupling areas at axially spaced locations, in which areas metal elements conveying a high electric potential are located opposite surface sections which are electrically connected to the metal walls via insulating dielectrics, the coupling areas being separated by a spacing dielectric.

BACKGROUND OF THE INVENTION

In such an arrangement, which is known from DE-A 41 07 552, the insulating dielectrics of the coupling areas are interconnected via ring-like bridges which consist of the same sealing compound as the insulating dielectrics.

The insulating dielectrics required in the coupling areas should have a great high-voltage stability. However, materials which are sufficiently resistant to high voltage cause inadmissible overheating in the ring-like bridges interconnecting the coupling areas due to the high-frequency field which is active in these bridges. When the cathode ray tube is switched on and off, high temperature differences are produced which lead to problems of adhesion between the metal parts and the sealing compound of the dielectrics.

SUMMARY OF THE INVENTION

It is an object of the invention to provide an arrangement of the type described in the opening paragraph which is both resistant to high voltage and also to temperature fluctuations.

This object is achieved in that the spacing dielectric consists of a different material than the insulating dielectrics and has a lower value of the product of loss factor and dielectric constant ($tg\delta \times \epsilon$) at a high frequency.

According to the invention, the insulating dielectrics and the connecting dielectric arranged between the coupling areas are formed separately, so that insulating areas can be optimized for a satisfactory high-voltage stability, but the connecting area can be optimized for low dielectric losses.

In a preferred embodiment, the spacing dielectric is air. In this case a bridge consisting of a solid material is dispensed with and instead a clearance is provided. The coupling areas, which are then mechanically separated from each other, are interconnected in a mechanically stable manner via the walls of the input resonator cavity.

If an embodiment is used, which comprises cylindrical metal walls and an annular space between the constituent walls, the outer cylindrical metal wall may be radially supported by the end region of the inner cylindrical metal wall so as to increase the stability.

A favourable embodiment is characterized in that radially extending supports are circumferentially arranged between the metal walls. Then, only small losses can be caused by the high-frequency field in these walls due to the small overall volume of the supports.

Moreover, it is favourable to use a material having a low product $tg\delta \times \epsilon$ for the supports, particularly teflon or a ceramic material.

These and other aspects of the invention will be apparent from and elucidated with reference to the embodiment described hereinafter.

BRIEF DESCRIPTION OF THE DRAWING FIGURES

In the drawing the figure shows partly in a cross-section the side elevation of an arrangement having an input resonator cavity according to the invention.

DESCRIPTION OF THE INVENTION

The arrangement shown in FIG. 1 constitutes an input resonator cavity having an elongate ring area 1 between cylindrical metal walls 2 and 3 and a bottom area 4. If the bottom area 4 has a sufficient volume, the ring area 1 may be dispensed with.

The electrically effective volume of the ring area 1 may be changed by shifting the adjusting element 5.

A plurality of teflon supports 16 evenly arranged on the circumference between the walls 2 and 3 is used for increasing the mechanical stability.

The metal wall 3 retains and fixes two groups of components. A coupling area 6 is formed in one group of components and a coupling area 7 is formed in the opposite group of components.

An annular disc-shaped component 10 electrically contacted with the cathode of the tube and conveying a high-voltage potential (30 kV) is located opposite the wall 2 and projects in the coupling area 7 between the metal parts 8 and 9 connected to the cylindrical wall 2. The parts 8, 9 and 10 are fixedly interconnected without the inclusion of air via a sealing compound 11 which is resistant to high voltage.

Analogously, a metallic circular element 12 conveying grid potential projects in the coupling area 6 within a connecting high-voltage resistant sealing compound 13 between two parts 14 and 15 connected in a conducting manner to the wall 3.

No fixed dielectric causing losses is present within the bottom area 4 of the input resonator cavity between the coupling areas 6 and 7.

The arrangement shown in the Figure is intended to be mounted on a cathode ray tube at its area shown at the right, the cathode area of the cathode ray tube then extending as far as the bottom area 4.

We claim:

1. In a cathode ray tube, an input resonator cavity structure comprising:

(a) a first metal wall;

(b) a second metal wall spaced apart from said first metal wall;

(c) each of said first metal wall and said second metal wall having surface sections in a coupling area for conveying a low electric potential, the coupling areas of the first and second metal walls being axially spaced from one another;

(d) metal elements in said coupling areas for conveying a high electric potential;

(e) insulating dielectrics in each of the coupling areas filling the spaces between the surface sections and the metal elements; and (f) a spacing dielectric extending between said coupling areas and separating said coupling areas, said spacing dielectric consisting of a different material than said insulating dielectrics, and said spacing dielectric having a lower value of the product of loss factor and dielectric constant ($tg\delta \times \epsilon$) at high frequencies than said insulating dielectrics.

2. A cathode ray tube as claimed in claim 1, characterized in that the spacing dielectric is air.

3. A cathode ray tube as claimed in claim 1 or 2, characterized in that the metal walls (2, 3) are cylindrical and in that the outer cylindrical metal wall (3) is radially supported by the end region of the inner cylindrical metal wall (2).

4. A cathode ray tube as claimed in claim 3, characterized in that radially extending supports (16) are circumferentially arranged between the metal walls (2, 3).

5. A cathode ray tube as claimed in claim 4, characterized in that the supports (16) are made of teflon or a ceramic material.

6. A cathode ray tube as claimed in claim 1, characterized in that the metal walls (2, 3) are cylindrical and in that the outer cylindrical metal wall (3) is radially supported by the end region of the inner cylindrical metal wall (2).

7. A cathode ray tube as claimed in claim 6, characterized in that radially extending supports (16) are circumferentially arranged between the metal walls (2, 3).

8. A cathode ray tube as claimed in claim 7, characterized in that the supports (16) are made of teflon or a ceramic material.

* * * * *